US007088336B2

(12) United States Patent
Hsu

(10) Patent No.: US 7,088,336 B2
(45) Date of Patent: Aug. 8, 2006

(54) PUSHBUTTON

(75) Inventor: Wei-Wen Hsu, Taipei (TW)

(73) Assignee: Inventec Multimedia & Telecom Corporation, Taipei (TW)

( * ) Notice: Subject to any disclaimer, the term of this patent is extended or adjusted under 35 U.S.C. 154(b) by 471 days.

(21) Appl. No.: 10/714,961

(22) Filed: Nov. 18, 2003

(65) Prior Publication Data

US 2005/0023122 A1 Feb. 3, 2005

(30) Foreign Application Priority Data

Mar. 11, 2003 (TW) ..... 92203619 U

(51) Int. Cl.
*G09G 5/00* (2006.01)

(52) U.S. Cl. ..... 345/156; 345/168; 341/22; 200/406

(58) Field of Classification Search ..... 345/156, 345/168; 341/20–27; 200/11, 18, 302, 406
See application file for complete search history.

(56) References Cited

U.S. PATENT DOCUMENTS

2001/0033270 A1* 10/2001 Osawa et al. ..... 345/168
2001/0040556 A1* 11/2001 Boireau et al. ..... 345/168
2003/0221943 A1* 12/2003 Masuda ..... 200/406

* cited by examiner

*Primary Examiner*—Richard Hjerpe
*Assistant Examiner*—Kimnhung Nguyen
(74) *Attorney, Agent, or Firm*—Rabin & Berdo, P.C.

(57) ABSTRACT

An improved pushbutton has a pair of elastic sections sandwiching a protrusive button. The elastic section includes a pair of elastic and flexible strips formed in an undulate manner to become a buffer member abutting a lateral side of the button to position the button in a vertical fashion. When the button is subject to a force the elastic sections may be compressed. When the force is released, the elastic sections are extended. The button may be embedded in a LCD panel at a smaller space, thus the overall size of the panel may be reduced.

3 Claims, 7 Drawing Sheets

PUSHBUTTON

FIELD OF THE INVENTION

The invention relates to an improved pushbutton and particularly to a pushbutton for use in thin LCD panels to save space.

BACKGROUND OF THE INVENTION

Nowadays a growing number of conventional CRT display devices of desktop computers have been replaced by LCD devices. The LCD device has gradually become a standard feature of the standard desktop computer. The LCD devices on the market also have constant innovations both in the design and structure,aiming at enlarging display panels and reducing thickness and weight.

In order to make the LCD panel thin and light, its accessories become very important in the structural design. The accessory that most directly relates to this concern is the multifunctional pushbutton for adjusting display brightness, contrast, and the like.

Refer to FIGS. 1 and 2 for a conventional LCD device. It includes a panel, 1, in which operation button cluster A occupies a large area. This mainly results in a button as a touch approach. Also refer to FIGS. 3A and 3B for the structure of a conventional plane touch button. It has a button, 11, with the periphery connecting to elastic strips 111. When the button is subject to pressure, its surface partially sinks. Such a structure requires a greater flat area for the button cluster A. As a result, when the button cluster A is wedged in the LCD panel, 1, it also takes a relative large area on panel 1. Consequently a greater area has to be allocated to accommodate the button cluster A during design of LCD panel 1. This is against the thin and light design trend of the LCD device.

SUMMARY OF THE INVENTION

In view of the aforesaid disadvantages, the primary object of the invention is to provide an improved pushbutton that alters the conventional plane touch structure to a vertical design so that it takes less space on the LCD panel and may greatly shrink the size of the entire panel.

The pushbutton according to the invention mainly is adopted for fabricating thin and light LCD panels. It has a pair of elastic sections connecting to a button in a protrusive manner. The elastic section has an undulate buffer member formed of an elastic and flexible strip, abutting a lateral side of the button so that the entire body becomes vertical. When the button is pressed, the elastic sections are compressed and the button sinks slightly. When the button is released, the tension of the elastic sections pushes the button to the original protrusive condition.

By means of the vertical structure, it greatly reduces the occupied space on the panel more than the conventional plane touch design. As a result, the size of the panel may be shrunk.

The foregoing, as well as additional objects, features and advantages of the invention will be more readily apparent from the following detailed description, which proceeds with reference to the accompanying drawings.

DESCRIPTION OF THE PREFERRED EMBODIMENTS

The improved pushbutton according to the invention aims at altering the horizontal touch button structure of the conventional LCD panel to a vertical structure so that it occupies less space on the LCD panel and the size of the entire panel may be reduced.

Figure 4A:
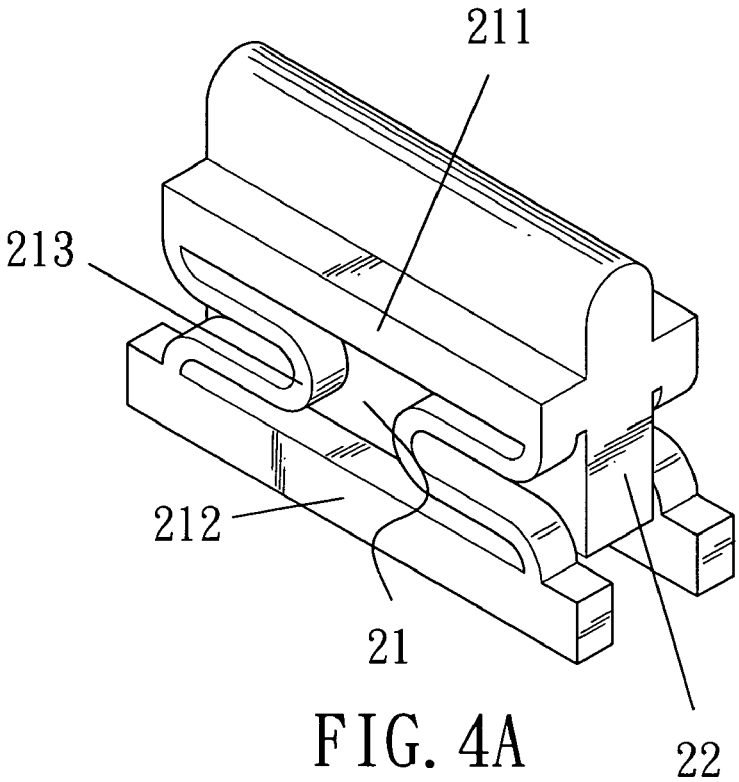
FIGS. 4A and 4B are schematic views of the pushbutton of the invention.
Figure 4B:
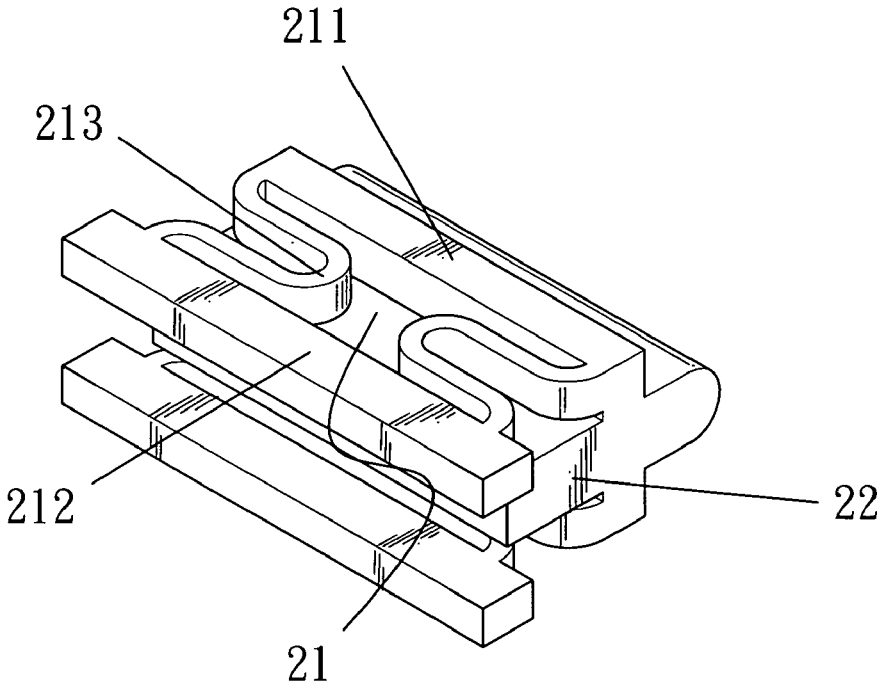

Refer to FIGS. 4A and 4B for the structure of a single pushbutton according to the invention. It includes a pair of elastic sections 21 that sandwiches a button 22 there between. Each of the elastic sections 21 includes a top ridge 211 and a bottom ridge 212 that bridge a set of buffer members 213. The buffer member 213 is made of an elastic and flexible strip formed in a undulate manner abutting a lateral side of the button 22. The top ridge 211 is connected to the button 22 on a desired location to allow the button 22 to be partially extended outside the elastic sections 21. It also may be formed by extending the undulate buffer member 213 with a top section thereof connecting to the lateral side of the button 22.

Figure 5A:
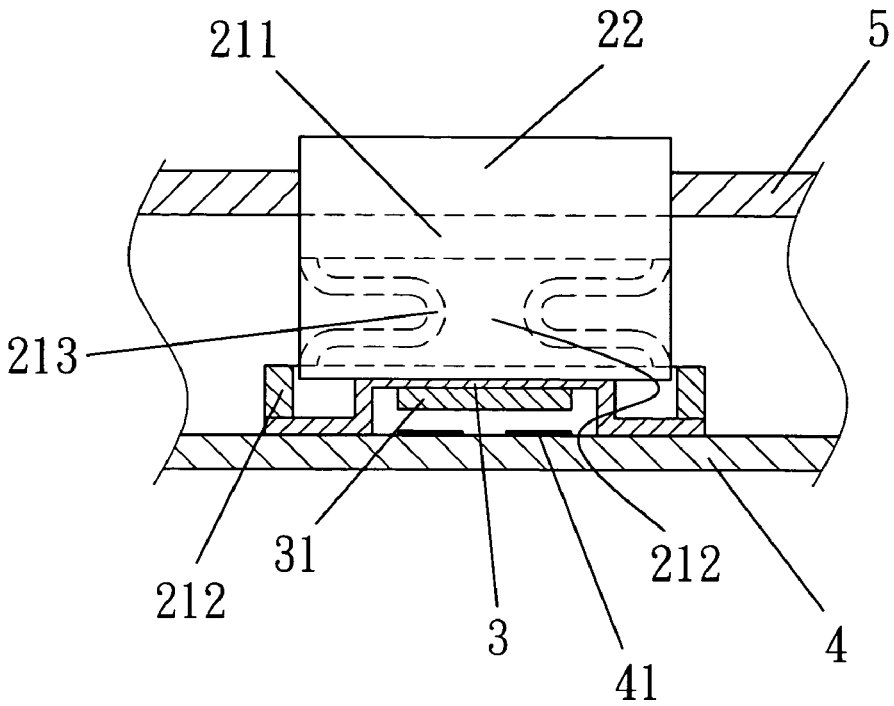
FIGS. 5A and 5B are sectional views of the pushbutton of the invention in operating conditions.
Figure 5B:
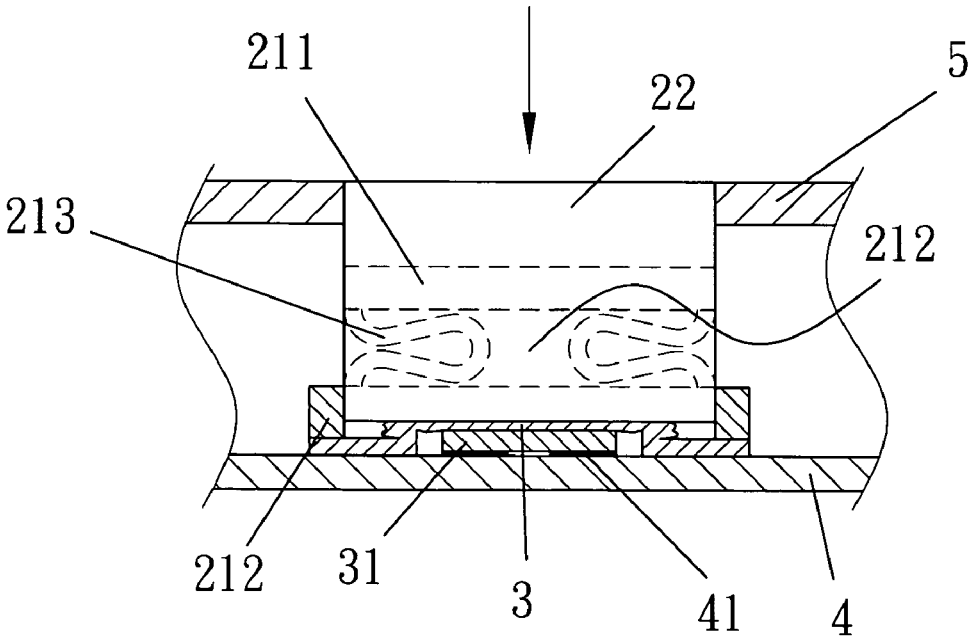

Referring to FIGS. 5A and 5B, when the pushbutton of the invention is wedged in a LCD panel 5, it straddles a switch 3 of a circuit board 4 inside the LCD panel. Namely, the bottom ridge 212 is stacked on the switch 3 with the bottom side of the button 22 in contact with the surface of the switch 3. Referring to FIG. 5B, when the button 22 is pressed and sinks slightly, due to the elasticity and flexibility of the buffer member 213, it is compressed and deformed instantly. Therefore the button 22 is pressed and lowered quickly to compress the switch 3 , to establish electric connection between a conductive member 31 inside and a connection point 41 of the circuit board 4.

When the compression force is released, the elasticity of the buffer member 213 generates a returning force to enable the buffer member 213 to be extended to its original condition before compression as shown in FIG. 5A. The button 22 also returns to its original position.

Figure 1:
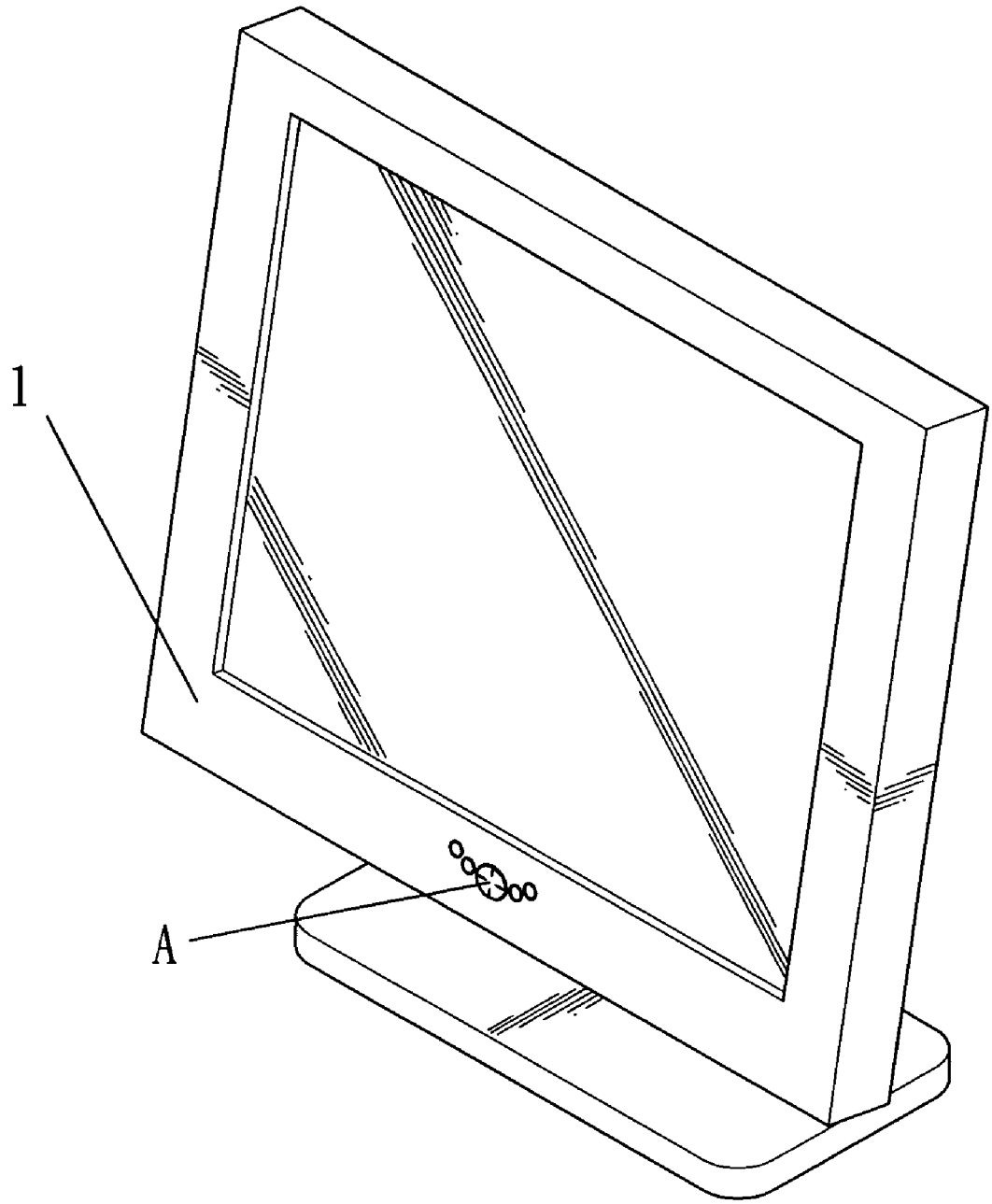
FIG. 1 (PRIOR ART)
FIG. 1 is a pictorial view of a conventional pushbutton cluster embedded in a panel.
Figure 2:
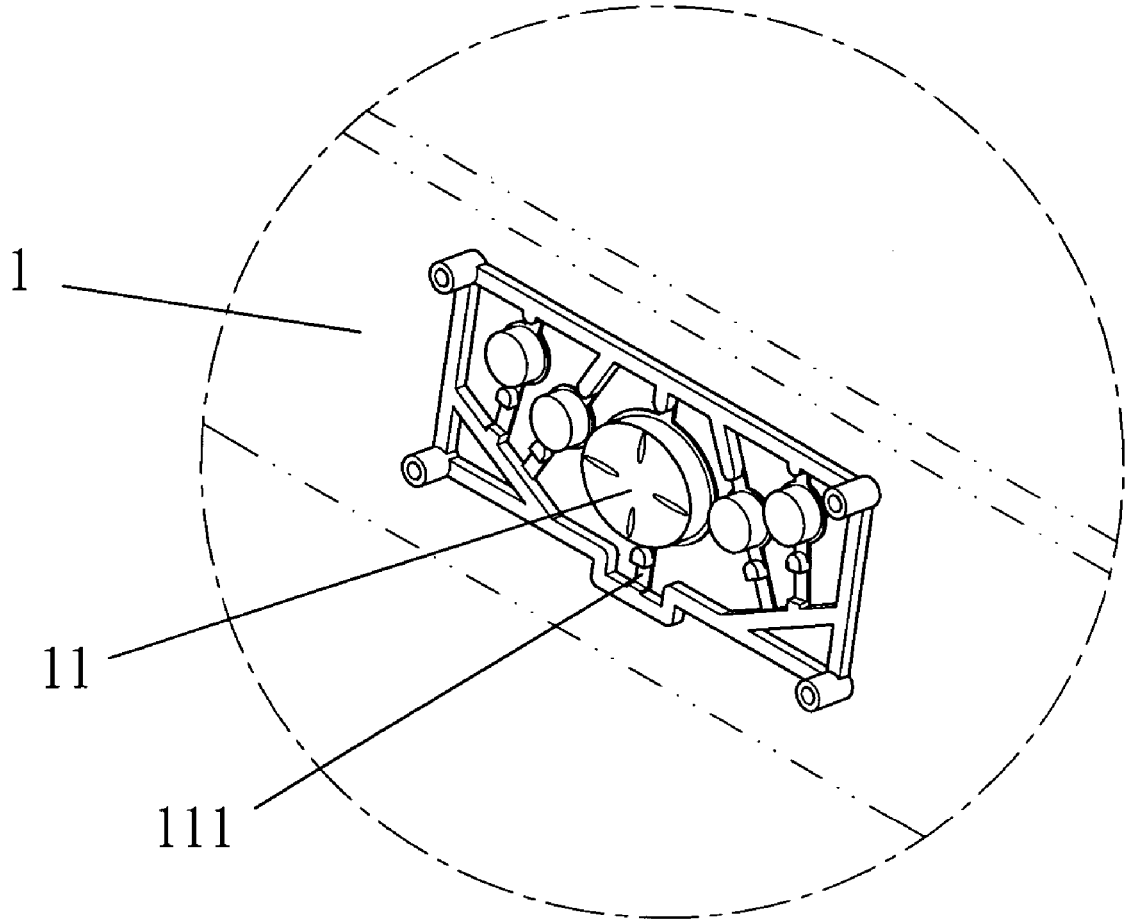
FIG. 2 (PRIOR ART)
FIG. 2 is a perspective view of a conventional pushbutton embedded in a panel.
Figure 3A:
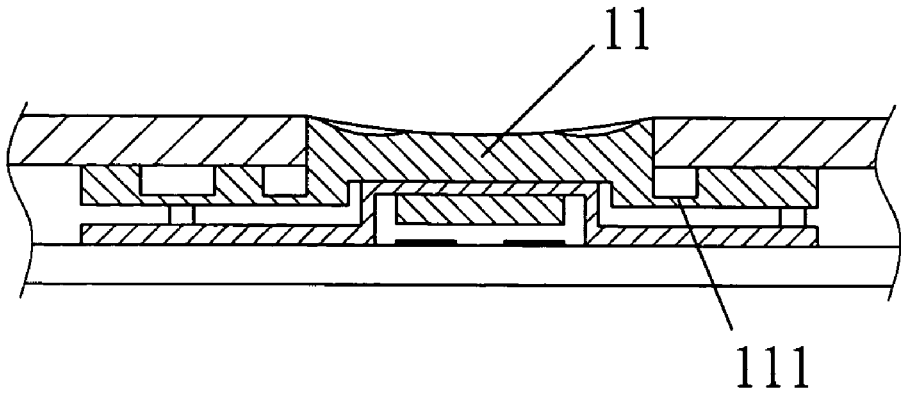
FIG. 3A (PRIOR ART)
FIGS. 3A and 3B are sectional views of a conventional pushbutton in operating conditions.
Figure 3B:
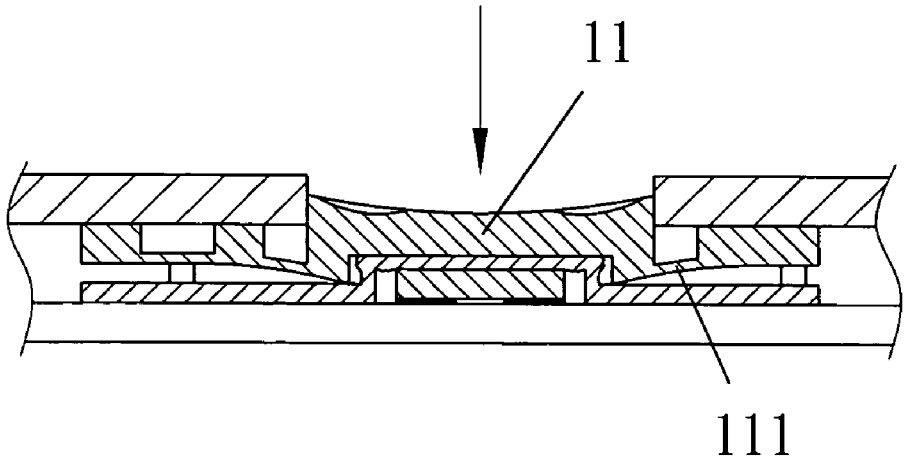
FIG. 3B (PRIOR ART)
Figure 6:
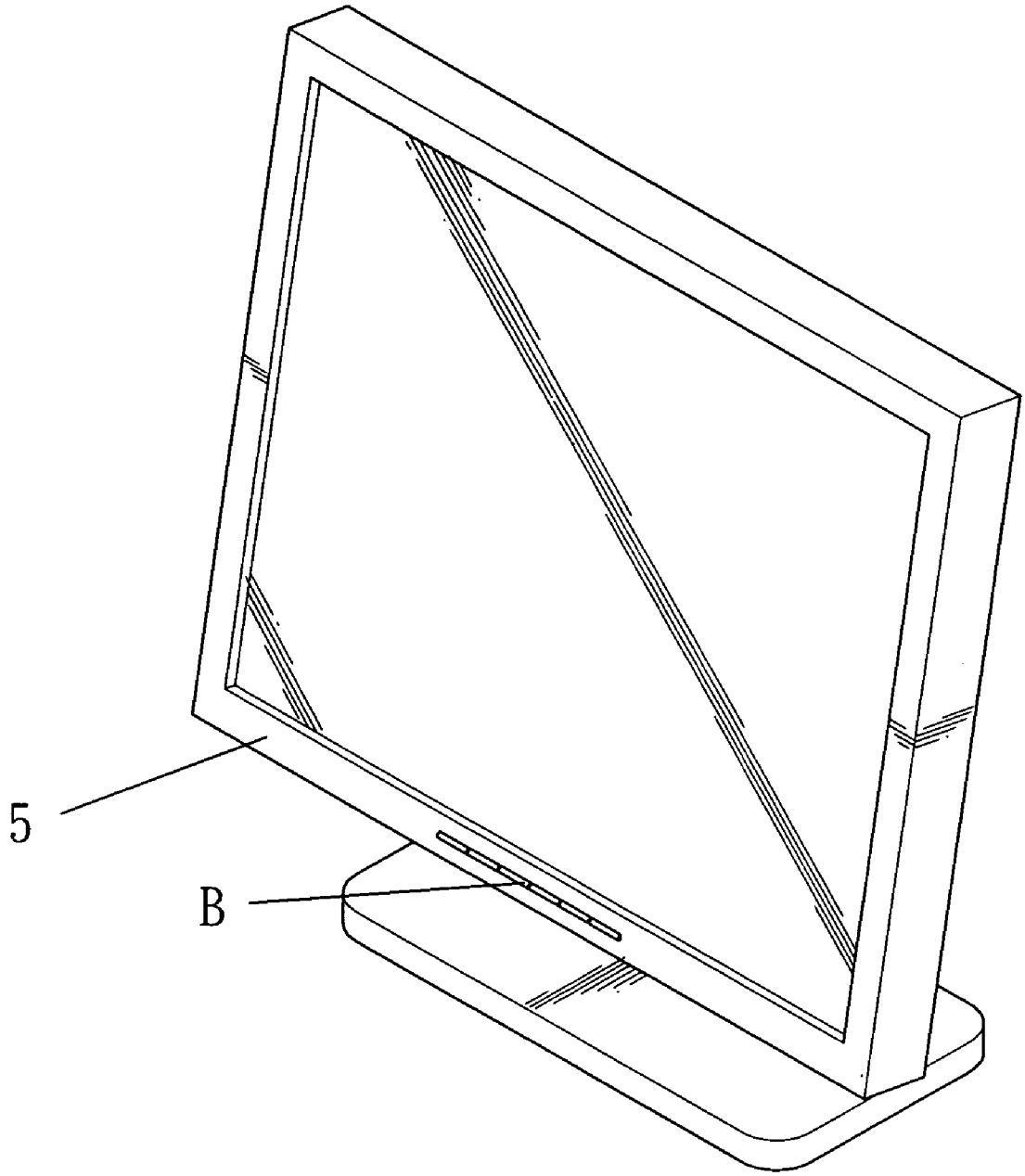
FIG. 6 is a pictorial view of the invention embedded in a panel.
Figure 7:
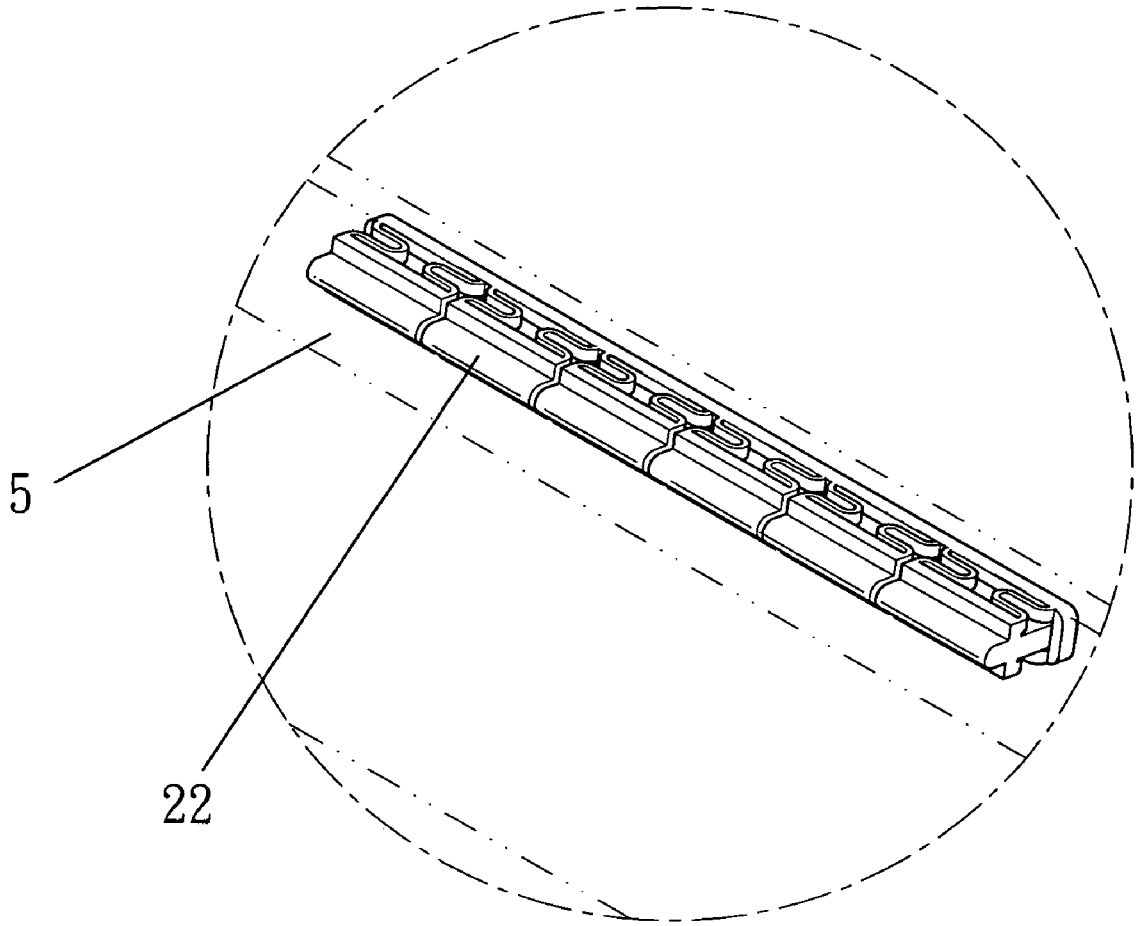
FIG. 7 is a perspective view of the invention embedded in a panel.

Refer to FIGS. 6 and 7 for the pushbutton of the invention that is juxtaposed to form a button row B on the panel 5. As each button adopts a vertical structure, it takes much less space than the conventional design of plane touch button cluster A shown in FIGS. 1 and 2. As a result, the LCD panel may be made smaller.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved pushbutton comprising a pair of elastic sections which sandwich a protrusive button such that the button is depressible to generate a compression and releasable to be extended, which is characteristic in that:

each of the elastic sections is made of an elastic and flexible strip and formed in a undulate manner abutting a lateral side of the button, and has a top section connecting to the lateral side of the button.

2. The improved pushbutton of claim 1, wherein the elastic section includes a top ridge, and a bottom ridge that bridge a set of buffer members therebetween, the top ridge being connected to the lateral side of the button on a desired location, the buffer member being made of an elastic and flexible strip formed in a undulate manner abutting the lateral side of the button.

3. The improved pushbutton of claim 1, wherein a plurality of the buttons are juxtaposed to form a row cluster.

* * * * *